US008575844B1

(12) United States Patent
Landt et al.

(10) Patent No.: US 8,575,844 B1
(45) Date of Patent: Nov. 5, 2013

(54) PLASMA KLYSTRON SWITCH

(75) Inventors: Don L. Landt, Palo, IA (US); Nathan P. Lower, North Liberty, IA (US); Roger A. Dana, Marion, IA (US); Mark M. Mulbrook, Marion, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 263 days.

(21) Appl. No.: 13/212,825

(22) Filed: Aug. 18, 2011

(51) Int. Cl.

| | |
|---|---|
| ***H01J 7/24*** | (2006.01) |
| ***H05B 31/26*** | (2006.01) |
| *H01J 1/62* | (2006.01) |
| *H01J 63/04* | (2006.01) |
| *H01J 17/49* | (2012.01) |

(52) U.S. Cl.
USPC ..... 315/111.21; 313/484; 313/586

(58) Field of Classification Search
None
See application file for complete search history.

(56) References Cited

U.S. PATENT DOCUMENTS 5,355,093 A * 10/1994 Treado et al. ..... 330/45
7,678,705 B2 * 3/2010 Nguyen et al. ..... 438/729

* cited by examiner

*Primary Examiner* — Douglas W Owens
*Assistant Examiner* — Dedei K Hammond
(74) *Attorney, Agent, or Firm* — Donna P. Suchy; Daniel M. Barbieri

(57) ABSTRACT

The plasma klystron switching device of the present invention may include a low-dielectric substrate, a plasma cavity internally pressurized by an inert gas, a circuit assembly formed on the first surface of the low-dielectric substrate and enclosed by the plasma cavity, wherein the circuit assembly includes a first electrode and a second electrode configured to form a switching gap, wherein the switching gap is configured to act as a high conductance plasma generation zone during an ON state of the plasma klystron switching device and a low conductance zone during an OFF state of the plasma klystron switching device, an evacuated klystron resonance generator, wherein the klystron resonance generator includes a klystron resonance cavity, wherein the klystron resonance generator includes a coupling aperture configured to RF couple the klystron resonance cavity and the plasma cavity, and a field emitter array configured to energize the klystron resonance generator.

18 Claims, 4 Drawing Sheets

PLASMA KLYSTRON SWITCH

TECHNICAL FIELD

The present invention generally relates to radio frequency (RF) switches and switching techniques, and more particularly to a plasma initiated conductance switch driven by the coupled output of a klystron resonance generator.

BACKGROUND

Due to the ever growing demands on present and future communication and navigation systems it is desirable to produce an improved high performance switch. State-of-the-art systems require radio frequency (RF), micrometer, and millimeter wave switching devices having a high level of performance over numerous switching characteristics. High performance switches are required in both small and large signal applications. For example, high performance switching devices are typically required in high power amplifiers (PAs), transmit/receive (T/R), and mixers. Current switching technologies are excessively lossy, have high insertion loss, exhibit poor isolation, and have slow switching speeds. MEM switches offer some improvement over other current switching technologies as they display low resistance in the 'ON' state and have acceptable levels of isolation while in the 'OFF' state. MEM switches, however, suffer from very low switching speeds, low reliability, contact sticking, the inability to handle high power levels, and large operating voltages (often greater than 100 V). As such, it is desirable to provide a RF switch with a very low 'ON' state resistance, low insertion loss, high isolation in the 'OFF' state, large power handling capabilities, wide frequency bandwidth of operation, low power consumption, small size, fast switching speeds, and wafer-scale fabrication.

SUMMARY

A plasma klystron switching device is disclosed. In one aspect, the plasma klystron switching device may include, but is not limited to, a low-dielectric substrate; a plasma cavity internally pressurized by an inert gas, wherein the plasma cavity is operably connected to a first surface of the low-dielectric substrate; a circuit assembly formed on the first surface of the low-dielectric substrate and enclosed by the plasma cavity, wherein the circuit assembly includes a first electrode and a second electrode, wherein the first electrode and second electrode are substantially coplanar and configured to form a switching gap between a first portion of the first electrode and a first portion of the second electrode, wherein the switching gap is configured to act as a high conductance plasma generation zone during an ON state of the plasma klystron switching device and a low conductance zone during an OFF state of the plasma klystron switching device; an evacuated klystron resonance generator having a first end portion operably connected to a second surface of the low-dielectric substrate, wherein the second surface of the low-dielectric substrate and the first surface of the low-dielectric substrate are on opposite sides of the low-dielectric substrate, wherein the klystron resonance generator includes one or more klystron resonance cavities, wherein one or more internal surfaces of the klystron resonance cavity are at least partially metalized, wherein the first portion of the klystron resonance generator includes a coupling aperture configured to RF couple the klystron resonance cavity and the plasma cavity and is at least partially aligned with the gap of the circuit assembly; and a field emitter array configured to energize the klystron resonance generator, wherein the field emitter array is disposed within a second end portion of the klystron resonator generator, wherein the second portion of the klystron resonance generator is positioned opposite of the first end portion of the klystron resonance generator.

BRIEF DESCRIPTION OF THE DRAWINGS

The numerous advantages of the disclosure may be better understood by those skilled in the art by reference to the accompanying figures in which.

DETAILED DESCRIPTION OF THE INVENTION

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention. Reference will now be made in detail to the subject matter disclosed, which is illustrated in the accompanying drawings.

Figure 1A:
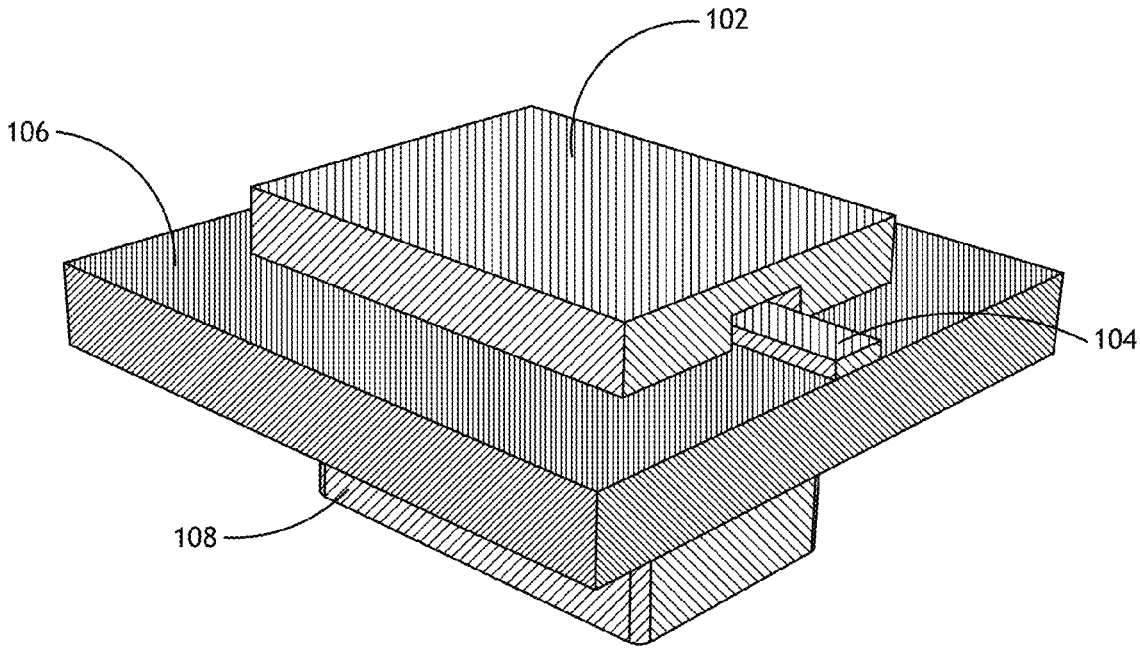
FIG. 1A is a glancing angle view of a plasma klystron switching device, in accordance with one embodiment of the present invention.
Figure 1B:
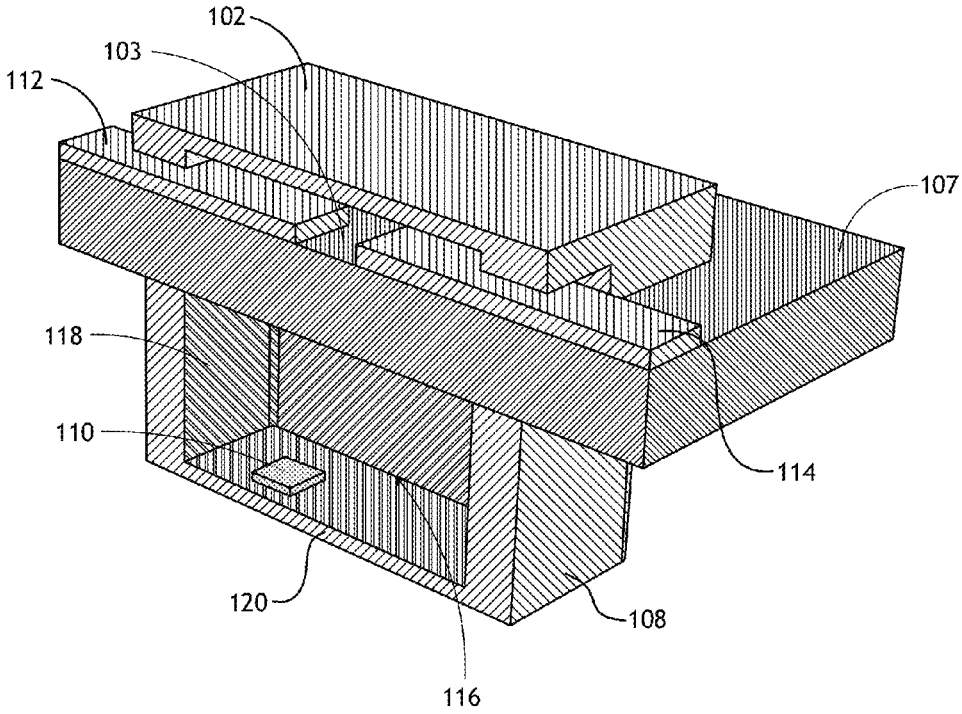
FIG. 1B is a glancing cross-sectional view of a plasma klystron switching device, in accordance with one embodiment of the present invention.
Figure 1C:
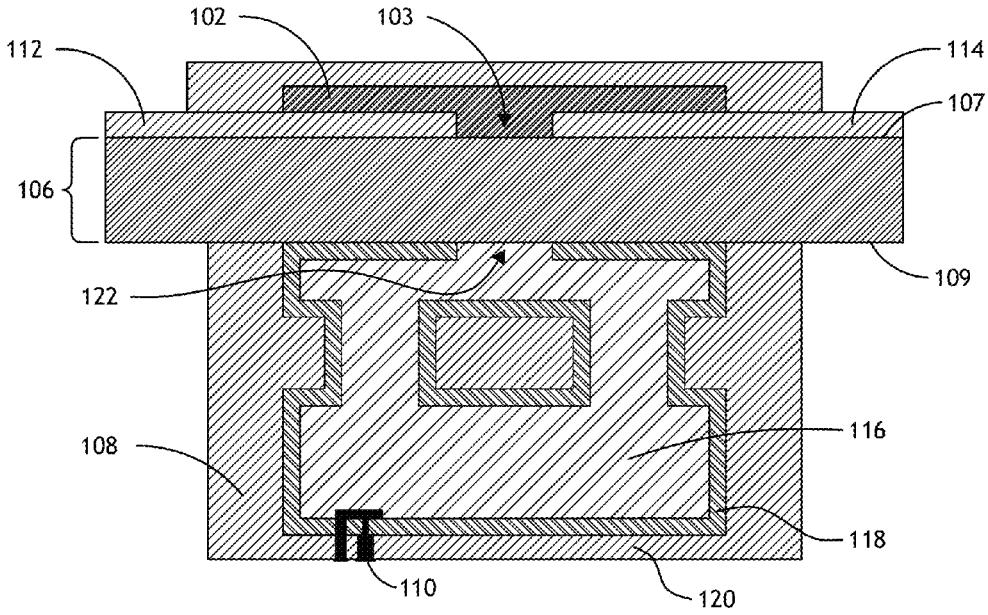
FIG. 1C is a cross-sectional view of a plasma klystron switching device, in accordance with one embodiment of the present invention.
Figure 2:
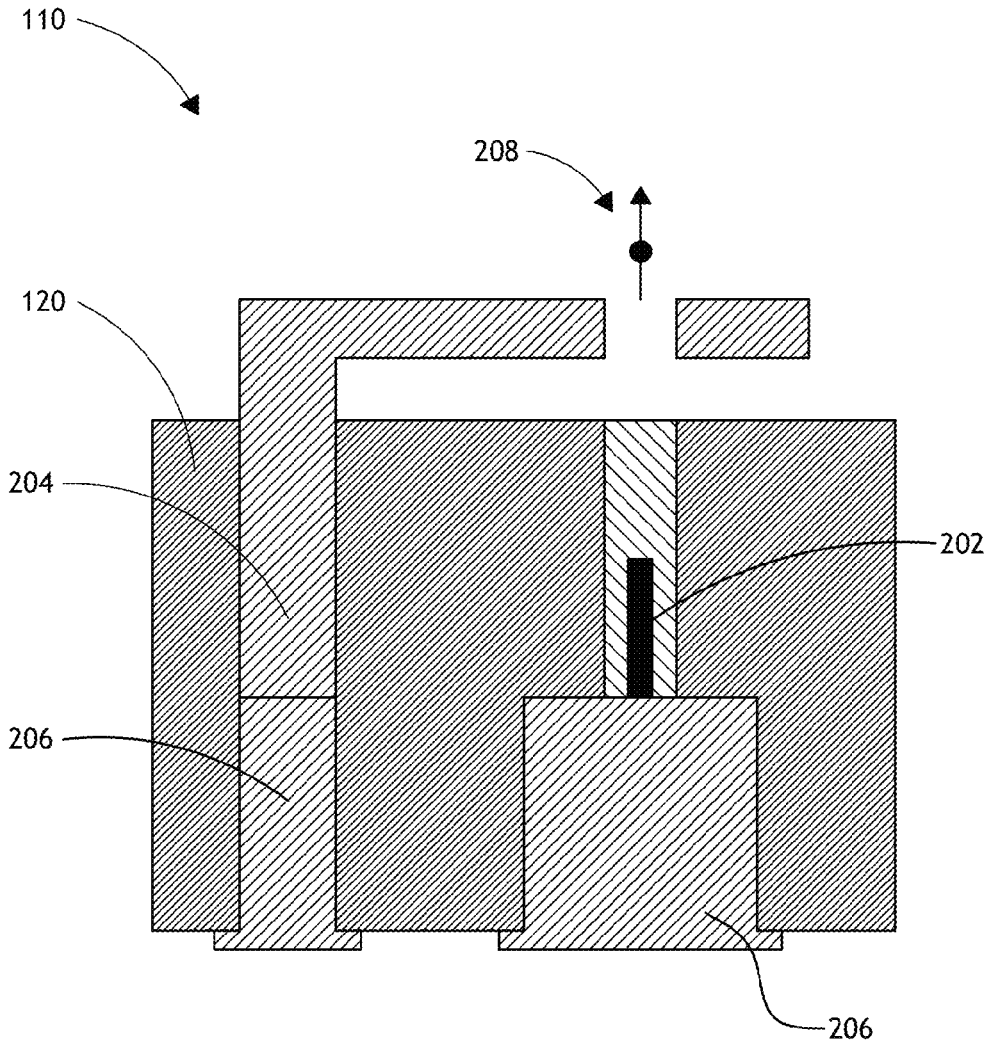
FIG. 2 is a schematic view of a field emitter array of a plasma klystron switching device, in accordance with one embodiment of the present invention.

Referring generally to FIGS. 1A through 2, a plasma klystron switching device 100 is described in accordance with the present disclosure. The plasma klystron switching device 100 of the present invention may utilized a high pressure, highly conductive RF-generated plasma in order to form a low resistance interconnect between electrodes of a circuit assembly 104. The plasma may be generated via radio frequency (RF) energy may be formed in an underlying klystron resonance generator 108. The klystron resonance generator 108 may consist of a direct current (DC) to RF self-oscillating device. During activation the klystron resonance generator 108 may act to produce millimeter-wave power, which in turn may excite and sustain the plasma contained within a plasma cavity 102 situated above a gap 103 between electrodes of the circuit assembly 104. The control of the RF coupling between the klystron resonance generator 108 and the gas (e.g., helium gas) contained within the plasma cavity 102 allows the device 100 to be utilized as a switching device. In this manner, the device 100 is 'ON' when the klystron generator 108 is energizing and maintaining the plasma of the plasma cavity 102 such that gap 103 between electrodes of the circuit assembly 104 is highly conductive. In contrast, the device is 'OFF' when the klystron generator 108 is not energizing the gas of the plasma cavity 102. It is contemplated herein that that klystron switching device 100 may be utilized as an RF switch or a logic element (e.g., AND gate or NOR gate).

Further, it is contemplated herein the plasma klystron switching device 100 may be fabricated utilizing a series of wafer level fabrication process. The utilization of a wafer level fabrication process allows for the fabrication of microscale small plasma klystron switching devices having no moving parts or active elements. As such, the plasma klystron switching device 100 of the present invention may be heated to a temperature as high of approximately 500° C.

FIGS. 1A through 1C illustrate schematic views of a plasma klystron switching device 100 in accordance with an exemplary embodiment of the present invention. The plasma switching device 100 may include a plasma cavity 102 operably connected to a top surface 107 of a low-dielectric substrate 106, wherein the plasma cavity 102 acts to enclose a switching gap 103 of a circuit assembly 104. In one aspect, the circuit assembly 104 may include a first electrode 112 and a second electrode 114 separated by the switching gap 103 and formed on the top surface of the low-dielectric substrate 106. In this manner, the switching gap 103 acts to serve as high conductance/low conductive switch between the first electrode 112 and the second electrode 114, such that that currently freely flows between the first electrode 112 and the second electrode 114 when the switching gap 103 is conductive (i.e., plasma generated in gap). In contrast, the gap 103 acts as a current stop when the switching gap 103 displays zero or very low conductance (i.e., no plasma generated in gap 103).

The plasma switching device 100 further includes an evacuated klystron resonance generator 108 having a top end operably connected to the bottom surface 109 of the low-dielectric substrate 106. The klystron resonance generator 108 further includes a klystron resonance cavity 116, wherein the surfaces 118 of the resonance cavity 116 are at least partially metalized. In addition, the top end of the klystron resonance generator 108 includes a coupling aperture 122 suitable for coupling the RF energy generated within the klystron resonance cavity 116 to the plasma generating switching gap 103. Moreover, the plasma switching device 100 includes a field emitter array 110 fabricated within the bottom end portion of the generator 108 configured to energize the klystron resonance generator 108. The plasma cavity 102 is pressurized and sealed with a high-pressure inert gas (e.g., helium) such that the switching gap 103 may provide a high conductance mode in an ON state when energized by the klystron resonance generator 108 and a low conductance mode in an OFF state (i.e., not energized by generator 108) of the switch 100. It should be recognized by those skilled in the art that the high conductance state results from the creation of free electron carriers associated with the plasma generated in the switching gap 103. In contrast, the low (or no) conductance state exists due to the lack of free electron carriers within the switching gap 103 in the absence of plasma generation.

In one aspect of the present invention, the plasma klystron switching device 100 may be fabricated utilizing a series of semiconductor wafer-level processing steps. Throughout the present disclosure the series of wafer-level processing steps utilized to fabricated the plasma klystron switching device 100 of the present invention will often be referred to as Z-FAB.

The Z-FAB based construction of the plasma klystron switching device 100 of the present invention may include building up the device 100 through a repetitive process of sequential patterning, plating, and planarizing. In a general sense, the Z-FAB process of the present invention provides the ability to fabricate complex electrical and mechanical structures on both a top side and bottom side of a wafer. As such, the component structures of the plasma klystron switching device 100 may be formed within a three-dimensional final structure. In one aspect, the Z-FAB process may include the application of a metal seed layer onto a semiconductor wafer surface. Following the application of the seed layer, the Z-FAB process may include a patterning step, a plating step, and a planarization step. Further, these Z-FAB process steps may be repeated in layer s in order to build up the three-dimensional structure of the plasma switching device 100. In this manner, the field emitter array 110, the klystron resonance generator 108 (including internal structure of resonance cavity 116), the plasma cavity 102 and switching gap 103 may be fabricated in a sequential and repetitive Z-FAB process.

Moreover, once circuitry and component structures are fabricated on a wafer, a wafer-to-wafer bonding process may be utilized in order to 'stack' multiple wafers together. It is further contemplated that the Z-FAB process of the present invention may be utilized to construct additional structures, such as dielectric materials, alternative metals, and coatings. It is further anticipated that the Z-FAB process may be performed without machining or post processing steps.

In one embodiment of the present invention, the circuit assembly 104 may include a first electrode 112 and a second electrode 114 patterned on the top surface of the low-dielectric substrate 106. For example, the first electrode 112 and the second electrode 114 may be deposited and/or patterned via any process known in the art, such as, but not limited to, evaporation or sputtering techniques. In a further embodiment, the first electrode 112 and second electrode 114 may be formed utilizing a variety of RF circuit technologies, such as, but not limited to, a microstrip, a stripline, a coaxial transmission line, conductive sheets in a waveguide topology, or conductive sheets in a free space topology. For example, a gap 103 fabricated at the center of a microstrip or stripline assembly may act to define the first electrode 112 and the second electrode 114, creating two independent electrodes separated by the switching gap 103. In another embodiment, the first 112 and second 114 electrodes of the circuit assembly 106 may be fabricated from a noble metal (e.g., gold or platinum).

Those skilled in the art should recognize that when fabricating a the circuit assembly 106, the gap 103 between the first 112 and second 114 electrodes should be large enough to ensure adequate electrical isolation between the electrodes while the switch 100 is in the OFF state. The electrical isolation between the first 112 and second 114 electrodes may be quantified by analyzing the stray capacitance between the ends of the circuit assembly 106 and the capacitance associated with the gap 103 of the circuit assembly 106. It is further recognized herein the that, while in the ON state, the fabricated set of electrodes 112 and 114 should display approximately zero conductance at low frequencies, while displaying only minimized capacitive impedances at high frequencies.

It is contemplated herein that the plasma generation zone of the plasma cavity 102 should have spatial dimensions of approximately between 20 to 100 μm.

In one aspect of the present invention, high pressure of the inert gas within the pressurized plasma cavity 102 acts to ensure production of high density plasma at the switching gap 103 during an ON state of the switching device 100. The high plasma density aids in increasing the conductance between the first electrode 112 and second electrode 114 while in the ON state. Moreover, high plasma density acts to shorten the mean free path (MFP) of the associated electrons, thereby decreasing the time required to transition from a plasma-ON to plasma-OFF state. In addition, the high pressure of the inert gas also has the effect of confining the generated plasma to a region in proximity with the excitation source. In one embodiment, the sealed plasma cavity 102 may be formed by constructing a sealed chamber over and around the region of the switching gap 103. For example, the sealed plasma cavity 102 may be fabricated by utilizing a Z-FAB process (as described previously herein) above and around the gap 103. Then, the native atmosphere (e.g., air) within the plasma cavity 102 may be evacuated and a light inert gas, such as, but not limited to, helium, may be back filled into the plasma cavity 102. After backfilling of the plasma cavity 102 with the light inert gas, the plasma cavity 102 may be sealed. Applicants note that inert gas pressure levels of between 200 to 800 Torr within the plasma cavity 102 allow for adequate transfer of millimeter-wave energy from the klystron resonance generator 108 to the electron gas, providing for adequate discharge. It should be recognized that this range of pressures is not limiting but rather should be interpreted merely as illustrative.

In one aspect of the present invention, the one or more klystron resonance cavities 116 of the resonance generator 108 may include a Beam Transit Time Oscillator (BTO). In one embodiment, the one or more klystron resonance cavities 116 of the klystron resonance generator 108 may include a single cavity BTO. For example, the BTO may consist of a single rectangular cavity, as shown in FIG. 1B, operating in the Transverse Magnetic (TM) 110 mode. In this instance, an electron beam may traverse the single cavity of the BTO and is collected on the top end of the klystron resonance generator 108. In another embodiment, the one or more klystron resonance cavities 116 of the klystron resonance generator 108 may include a double cavity BTO. For example, the BTO may consist of two rectangular cavities, as shown in FIG. 1C, operating in the Transverse Electric (TE) 101 mode. In this instance, an electron beam traverses the two cavities of the BTO and is collected on the top end of the klystron resonance generator 108. It is recognized herein that a two-cavity BTO may be particularly advantageous as it may provide superior DC-to-millimeter wave efficiency. In a further aspect, the BTO may act to initiate and maintain plasma generation at the switching gap 103 of the plasma cavity during an ON state of the switch 100.

It should be recognized by those skilled in the art that different resonant cavity 116 configurations may be more or less suitable in different contexts. For example, a klystron resonance cavity 116 configured as a double cavity BTO may be particularly advantageous in settings where fast switching times are paramount. By way of another example, a klystron resonance cavity 116 configured as a single cavity BTO may be particularly advantageous in settings where size (i.e., device footprint) is a limiting factor.

It is recognized herein that the single cavity klystron BTO source may display output frequencies in the range of 60 to 100 GHz, while the double cavity klystron BTO source may possess output frequencies in the range of 100 to 200 GHz. It is further recognized that the above frequency ranges are not limiting but should merely be interpreted as illustrative. It should be recognized by those skilled in the art that the utilization of higher excitation frequencies from the klystron resonance generator 108 increases the maximum plasma density generated at the switching gap 103 within the plasma cavity 102. As such, utilization of higher excitation frequencies in turn allows for improved energy transfer efficiency between the resonance cavity 116 and the plasma of the plasma cavity 102.

In one embodiment, the resonant cavity or cavities of the BTO may be formed utilizing a metalized silicon substrate. In this manner, the one or more resonators may be formed by etching partial vias in the metalized silicon substrate. This etched metalized substrate may then be operably coupled to the low-dielectric substrate 106 and the BTO cavity or cavities may be sealed to form the klystron resonance cavity 116.

In another aspect of the present invention, the klystron resonance cavity 116 of the generator 108 may be evacuated by pumping the resonance cavity 116 down to a high vacuum level prior to sealing the cavity 116. Applicants note that vacuum levels of $10^{-6}$ to $10^{-7}$ Torr are sufficient to sustain sufficient electron emission in the klystron resonance cavity, 116. It should be recognized that the above pressure range is not limiting and therefore should be interpreted as merely illustrative.

In another aspect of the present invention, the top end portion of the klystron resonance generator 108 includes a coupling aperture 122 configured to couple the RF energy generated in the klystron resonance cavity 116 to the plasma generation region of the switching gap 103. It is noted that except for the coupling aperture 122 the entire interior surface 118 of the klystron resonance cavity 116 is metalized. The coupling aperture 122 may be fabricated by removing a rectangular portion of the ground plane on the inside top end surface of the klystron resonance cavity 116, creating a rectangular waveguide positioned on the bottom surface of the low-dielectric substrate 106. Moreover, the coupling aperture 122 may be substantially aligned with the switching gap 103, so as to maximize RF coupling between the resonance cavity 116 and the switching gap 103.

It is recognized herein that a Z-FAB process similar to that described previously herein may be utilized to create the rectangular waveguide positioned on the bottom surface of the substrate 106.

In another aspect of the present invention, the low-dielectric substrate 106 may include a low-dielectric substrate having high mechanical strength. The low-dielectric/high-strength substrate simultaneously serves as the RF coupling aperture 122 as well as a mechanical barrier between the high pressure plasma cavity 102 and the high vacuum klystron resonance cavity 116. Any material known in the art may be suitable for implementation in the low-dielectric substrate 106. One material that is particularly useful in this context is diamond. As such, the low-dielectric substrate 106 may be formed from diamond.

It is contemplated herein that the wave guide dimensions of the klystron resonance generator 108 and the dimensions of the gap 103 may be approximately the same. In one embodiment, the gap 103 and waveguide 116 dimensions may be on the order of 20 to 100 μm.

Referring now to FIG. 2, in another aspect of the present invention, the field emitter array 110 of the klystron resonance generator 108 may include a plurality of carbon nanotubes (CNTs) 202. In one embodiment, the CNTs 202 of the present invention may be grown on the surface of a metalized silicon substrate. In this regard, the bottom end portion 120 of the klystron resonance generator 108 may be formed from a metalized silicon substrate. As such, partial vias may be etched into a metalized silicon substrate to a selected depth (e.g., 50 μm). Then, a catalyst may be applied to the bottom portion of the vias and a column of multi-walled CNTs may be grown. The CNTs 202 of this column may serve as the field emitters of the klystron resonance generator 108. After growing the CNT based field emitters on the metalized silicon substrate, the silicon substrate may then be operably coupled to the low-dielectric substrate 106 and the klystron resonance generator 108 may be evacuated.

Due to the elongated shape of the CNTs of the emitter array and the result field amplification, it is recognized herein that that CNT based emitter array is capable of producing very high electric fields at the tip of the CNTS using relatively small voltages (e.g., less than 100 V). Moreover, due to the large activation energy required for surface migration of the atoms of the CNT based emitter, the tip of a given CNT may withstand very large electric fields, which are required for field emission.

It is further recognized that CNTs also have high tensile strength, are chemically inert, and have very low sputter coefficients, which are factors which all improve the reliability of a CNT based field emitter.

It is further recognized that the mean free path for electrons in a CNT are relatively large. Due to the size of the electron mean free path in a CNT, during voltage application, electrons are accelerated toward the tip of the CNT at ballistic velocities. The energies of the accelerated electrons 208 are sufficiently large to overcome the work function of the CNT material. The accelerated electrons 208 of a given CNT are field emitted from the tip of the CNT and an electron beam is formed between the tip of the CNT and the top end portion of the klystron resonance generator 108. As such, energy extracted from the electron beam column as millimeter-wave energy builds up in the one or more resonance cavities 116. This build up within the one or more resonance cavities 116 occurs very rapidly (e.g., small number of periods associated with the output frequency).

In a further embodiment, the klystron resonance generator 108 may include an extinguishing electrode 204 as illustrated in FIG. 2.

In an alternative embodiment, the field emitter array 110 may be constructed of nano- or microscale metallic pyramids. For example, the field emitter array 110 may include a plurality of nanoscale molybdenum pyramidal structures. The fabrication of molybdenum pyramidal structures is well known in the art. As such, any suitable molybdenum pyramidal fabrication process known in the art may be implemented in the present invention.

In an additional alternative embodiment, the field emitter array 110 may be constructed of metallic shafts having tapered ends. For example, the field emitter array 110 may include a plurality of tungsten shafts having tapered (i.e., 'tipped') ends. The fabrication of tungsten tips is well known in the art. As such, any suitable tungsten tip fabrication process known in the art, such as those process utilized to fabricate STM tips (e.g., electrochemical etching and drawing), may be implemented in the present invention The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein.

Furthermore, it is to be understood that the invention is defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present.

For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

Although particular embodiments of this invention have been illustrated, it is apparent that various modifications and embodiments of the invention may be made by those skilled in the art without departing from the scope and spirit of the foregoing disclosure. Accordingly, the scope of the invention should be limited only by the claims appended hereto.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

What is claimed:

1. A plasma klystron switching device, comprising:

a low-dielectric substrate;

a plasma cavity internally pressurized by an inert gas, wherein the plasma cavity is operably connected to a first surface of the low-dielectric substrate;

a circuit assembly formed on the first surface of the low-dielectric substrate and enclosed by the plasma cavity, wherein the circuit assembly includes a first electrode and a second electrode, wherein the first electrode and second electrode are substantially coplanar and configured to form a switching gap between a first portion of the first electrode and a first portion of the second electrode, wherein the switching gap is configured to act as a high conductance plasma generation zone during an ON state of the plasma klystron switching device and a low conductance zone during an OFF state of the plasma klystron switching device;

an evacuated klystron resonance generator having a first end portion operably connected to a second surface of the low-dielectric substrate, wherein the second surface of the low-dielectric substrate and the first surface of the low-dielectric substrate are on opposite sides of the low-dielectric substrate, wherein the klystron resonance generator includes one or more klystron resonance cavities, wherein one or more internal surfaces of the one or more klystron resonance cavities are at least partially metalized, wherein the first portion of the klystron resonance generator includes a coupling aperture configured to RF couple the one or more klystron resonance cavities and the plasma cavity and is at least partially aligned with the gap of the circuit assembly; and a field emitter array configured to energize the klystron resonance generator, wherein the field emitter array is disposed within a second end portion of the klystron resonator generator, wherein the second end portion of the klystron resonance generator is positioned opposite of the first end portion of the klystron resonance generator.

2. The plasma klystron switching device of claim 1, wherein the one or more klystron resonance cavities of the klystron resonance generator comprise:

a single cavity beam transit time oscillator (BTO).

3. The plasma klystron switching device of claim 1, wherein the one or more klystron resonance cavities of the klystron resonance generator comprise:

a double cavity beam transit time oscillator (BTO).

4. The plasma klystron switching device of claim 1, wherein the one or more klystron resonance cavities have an output signal between 100 and 200 GHz.

5. The plasma klystron switching device of claim 1, wherein the one or more klystron resonance cavities have an output signal between 60 and 100 GHz.

6. The plasma klystron switching device of claim 1, wherein the field emitter array comprise:

a plurality of carbon nanotubes (CNTs).

7. The plasma klystron switching device of claim 1, wherein the field emitter array comprise:

a plurality of metallic pyramidal structures.

8. The plasma klystron switching device of claim 1, wherein the field emitter array comprise:

a plurality of metallic shafts, wherein each of the metallic shafts has a tapered end.

9. The plasma klystron switching device of claim 1, wherein the one or more klystron resonance cavities is evacuated to a pressure level between $10^{-6}$ and $10^{-7}$ Torr.

10. The plasma klystron switching device of claim 1, wherein the plasma cavity is pressurized to a pressure level between 300 and 800 Torr.

11. The plasma klystron switching device of claim 1, wherein the inert gas of the pressurized plasma cavity comprises:

helium gas.

12. The plasma klystron switching device of claim 1, wherein the low-dielectric substrate comprises:

a diamond substrate.

13. The plasma klystron switching device of claim 1, wherein the circuit assembly comprises:

one or more microstrip assemblies.

14. The plasma klystron switching device of claim 1, wherein the circuit assembly comprises:

one or more stripline assemblies.

15. The plasma klystron switching device of claim 1, wherein the circuit assembly comprises:

one or more coaxial transmission lines.

16. The plasma klystron switching device of claim 1, wherein the circuit assembly comprises:

a circuit assembly fabricated from a noble metal.

17. The plasma klystron switching device of claim 1, wherein the second end portion of the klystron resonance generator comprises:

a silicon substrate.

18. The plasma klystron switching device of claim 1, wherein the plasma klystron switching device is fabricated via a series of wafer-level processing steps.

* * * * *